US008092578B2

(12) United States Patent
Shulfer et al.

(10) Patent No.: US 8,092,578 B2
(45) Date of Patent: Jan. 10, 2012

(54) METHOD AND APPARATUS FOR ELIMINATING OR REDUCING WASTE EFFLUENT FROM A WET ELECTROSTATIC PRECIPITATOR

(75) Inventors: Joseph Shulfer, Woodstock, IL (US); Eberhard Veit, Crystal Lake, IL (US)

(73) Assignee: Eisenmann Corporation, Crystal Lake, IL (US)

( * ) Notice: Subject to any disclaimer, the term of this patent is extended or adjusted under 35 U.S.C. 154(b) by 749 days.

(21) Appl. No.: 12/197,776

(22) Filed: Aug. 25, 2008

(65) Prior Publication Data

US 2010/0043634 A1 Feb. 25, 2010

(51) Int. Cl.
*B03C 3/014* (2006.01)

(52) U.S. Cl. ..... 95/64; 95/65; 95/66; 95/71; 96/44; 96/47; 96/52; 96/74

(58) Field of Classification Search ..... 95/64–66, 95/71, 75; 96/43–50, 52, 53, 74
See application file for complete search history.

(56) References Cited

U.S. PATENT DOCUMENTS 4,039,304 A * 8/1977 Bechthold et al. ..... 95/66
4,070,424 A * 1/1978 Olson et al. ..... 261/142
4,208,192 A * 6/1980 Quigley et al. ..... 95/2
4,308,105 A * 12/1981 Schiffers et al. ..... 202/197
4,844,723 A * 7/1989 Tellini et al. ..... 96/18
5,000,762 A * 3/1991 Lindquist et al. ..... 95/66
7,297,182 B2 11/2007 Ray et al.
7,318,857 B2 1/2008 Ray et al.
2003/0056648 A1* 3/2003 Fornai et al. ..... 95/65
2007/0169625 A1* 7/2007 Aines et al. ..... 95/236
* cited by examiner

*Primary Examiner* — Richard L Chiesa
(74) *Attorney, Agent, or Firm* — Brinks Hofer Gilson & Lione

(57) ABSTRACT

A method and apparatus are provided for reducing waste effluent from a system including a boiler and a wet electrostatic precipitator, the waste effluent having blow down water discharged by the boiler during a blow down operation and bleed water discharged by the wet electrostatic precipitator. The method includes collecting the blow down water and providing it to the wet electrostatic precipitator as a makeup water supplement, evaporating a portion of the bleed water and leaving residual bleed water, providing the evaporated bleed water to the wet electrostatic precipitator as a further makeup water supplement, and using the residual bleed water to quench ash produced by combustion of solid fuel by the boiler. The apparatus includes an evaporator that provides direct contact between hot boiler flue gas and the bleed water such that a portion of the flue gas is quenched before being provided to the wet electrostatic precipitator.

20 Claims, 10 Drawing Sheets

$$\dot{m}_{blow} + \dot{m}_{demand} = \dot{m}_{cond} + \dot{m}_{makeup}$$

METHOD AND APPARATUS FOR ELIMINATING OR REDUCING WASTE EFFLUENT FROM A WET ELECTROSTATIC PRECIPITATOR

FIELD OF THE INVENTION

This invention pertains to a method and apparatus for reducing or eliminating the waste stream of water or sludge effluent from a wet electrostatic precipitator that is used to treat the flue gas from a solid fuel boiler.

BACKGROUND OF THE INVENTION

Many industrial processes utilize steam created by a boiler that is fed by a solid fuel such as coal, wood, biomass, or other similar material. Such fuels, when combusted, produce ash and other fine particulate matter as by-products which must be removed from the flue gas of the boiler prior to release of the flue gas to the atmosphere. Acid gas emissions may also be present. A wet electrostatic precipitator (WESP) is often used to remove particulate matter from the flue gas, in the presence or absence of acid gas emissions.

As described, for example in U.S. Pat. Nos. 7,297,182 and 7,318,857, commonly owned with the present application, a wet electrostatic precipitator requires a supply of water for quenching the flue gas. Most of this water is evaporated into the flue gas and thus exits the WESP into the atmosphere, but a portion of this water is discharged from the WESP as bleed water. The bleed water has historically been handled in several different ways, including disposal through a municipal sewer system, disposal through a water treatment facility, disposal to a settling pond, and processing in commercially available equipment that includes centrifuges and evaporators. Disadvantages of these prior methods for disposal of the bleed water include, but are not limited to, problems with environmental permit compliance (especially for zero liquid discharge facilities) and high cost of operation for centrifuge and evaporator systems.

A steady supply of fresh makeup water is typically required to replace the water evaporated into the flue gas and water discharged as bleed water, and a steady stream of waste effluent comprising bleed water must typically be treated and/or disposed of. For a system of industrial scale, the cost of supplying the fresh makeup water and the cost of treating and/or disposing of the waste effluent can be substantial.

Further, a steam boiler is typically periodically subjected to a blow down operation in which an amount of water in the bottom of the boiler is discharged in order to reduce the concentration of contaminants such as solids and chloride that could have detrimental effects on the operation of the boiler and related equipment. The blow down water is waste effluent that typically must be treated and/or disposed of, again at a substantial cost due to the sheer quantity of waste effluent that is generated for a boiler of industrial scale.

BRIEF SUMMARY OF THE INVENTION

In one embodiment, a method is provided for reducing waste effluent from a system including a boiler and a wet electrostatic precipitator, the waste effluent comprising blow down water discharged from the boiler during a blow down operation and bleed water discharged by the wet electrostatic precipitator. The method includes collecting the blow down water and providing the collected blow down water to the wet electrostatic precipitator as a makeup water supplement, thereby simultaneously reusing the blow down water and reducing the fresh makeup water requirement for the wet electrostatic precipitator.

In another embodiment, a method is provided for reducing the bleed water waste effluent from a wet electrostatic precipitator. The method comprises evaporating at least a portion of the bleed water. Using flue gas to evaporate the bleed water would further reduce the quench water makeup requirement of the wet-electrostatic precipitator, thereby simultaneously reducing the bleed water waste effluent and reducing the fresh makeup water requirement for the wet electrostatic precipitator.

In yet another embodiment, a method is provided for reducing to zero the waste effluent from a system including a boiler and a wet electrostatic precipitator, the waste effluent comprising blow down water discharged by the boiler during a blow down operation and bleed water discharged by the wet electrostatic precipitator. The method comprises collecting the blow down water, providing the collected blow down water to the wet electrostatic precipitator as a makeup water supplement, evaporating a portion of the bleed water and leaving residual bleed water, and using the residual bleed water to quench ash produced by combustion of solid fuel by the boiler, thereby reducing to zero the waste effluent from the system. Using flue gas to evaporate the bleed water would further reduce the quench water makeup requirement of the wet electrostatic precipitator.

In still another embodiment, an apparatus is provided for reducing waste effluent from a system including a boiler and a wet electrostatic precipitator, the waste effluent comprising blow down water discharged by the boiler and bleed water discharged by the wet electrostatic precipitator. The apparatus comprises an evaporator for evaporating at least a portion of the bleed water. Using flue gas to evaporate the bleed water would further reduce the quench water makeup requirement of the wet electrostatic precipitator.

DETAILED DESCRIPTION OF THE INVENTION

The following examples further illustrate the invention but, of course, should not be construed as in any way limiting its scope.

Figure 1A:
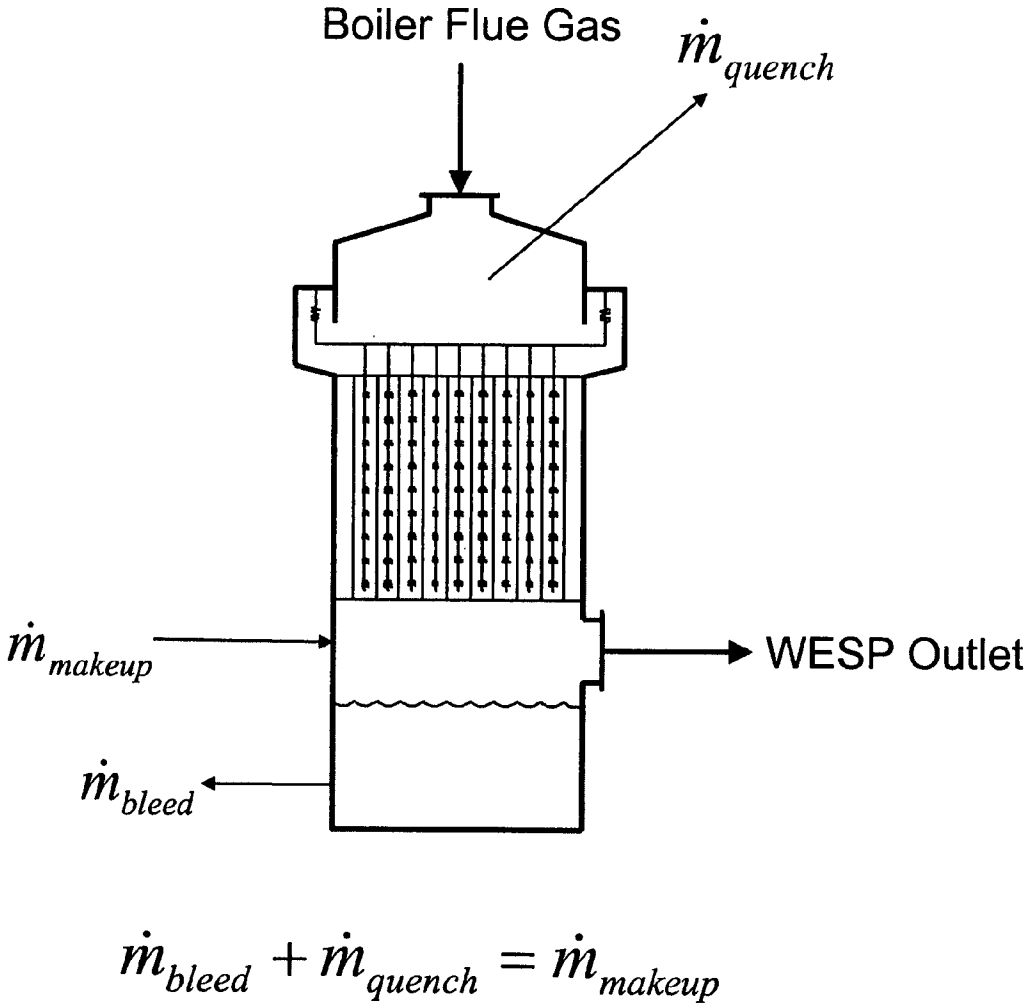
FIG. 1A is a schematic depicting the mass balance of water for a wet electrostatic precipitator.

There is shown in FIG. 1A a schematic diagram and mass balance of water for an embodiment of a wet electrostatic precipitator (WESP). A boiler flue gas, containing particulates and possibly also containing acid gas, enters the WESP and is exposed to a spray of water which quenches the flue gas and assists in the removal of the particulates and scrubbing of the acid gas. As a result, a scrubbed flue gas emerges from the WESP. An amount of the water spray, denoted as $m_{quench}$, evaporates as it quenches the flue gas and is carried out of the WESP in the scrubbed flue gas. Another amount of the water spray, denoted as $m_{bleed}$, is discharged from the bottom of the WESP to remove accumulated settled, suspended or dissolved solids. (The water in the bottom of the WESP begins to form a sludge over time as particulate matter accumulates. Salts and chloride concentration also begins to increase in the sludge and water over time.) The rate of discharge of bleed water is determined based on the solids percent and chloride concentration of the WESP liquor. Because a WESP is typically made from stainless steel or other similar material resistant to corrosion, the WESP usually can tolerate higher chloride concentrations. Also, bleed water needs to be discharged when the solids concentration in the bottom of the WESP exceeds certain limits.

Figure 1B:
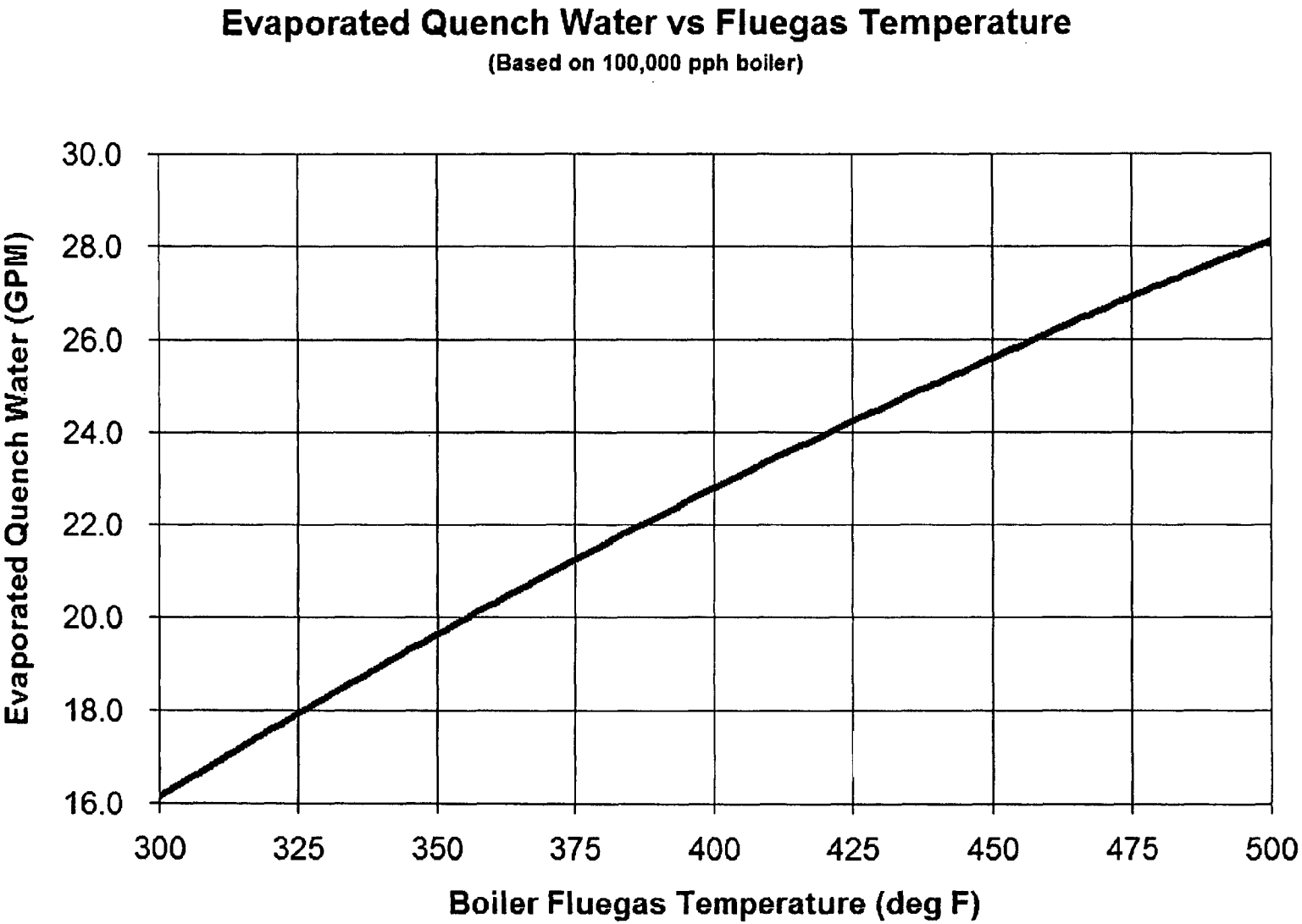
FIG. 1B is a graph showing the variation in required quench spray flow rate as a function of the temperature of the boiler flue gas being treated in a wet electrostatic precipitator, for a specified flow rate of flue gas.

As a result of evaporative losses due to quenching, as well as the discharge of bleed water, a replacement amount of water, denoted as $m_{makeup}$, must be added to the WESP in order to achieve a mass balance of water, wherein $m_{makeup}=m_{bleed}+m_{quench}$. FIG. 1B illustrates that the required amount of quench spray, and as a result the required amounts of bleed and WESP makeup water, depends on the flow rate of flue gas (the graph being at a flow rate typical for a 100,000 lb/hr steam boiler), the moisture content of the flue gas (the graph being at a 15% moisture content), and the flue gas temperature entering the WESP. The flue gas flow rate and moisture content indicated in FIG. 1B are exemplary only, and the flue gas temperature range of about 300° F. to about 500° F. is typical, although flue gas temperatures can be higher or lower than that range. For a higher flue gas temperature, more quench water is used, more bleed water is generated, and thus more makeup water is required.

The amounts of makeup water required and bleed water discharged by a WESP can be substantial. In one example, a boiler creating 100,000 pounds per hour of steam generates about 67,000 ACFM of flue gas at 400° F. and 15% moisture, which will require about 22.8 GPM of quench water and will result in about 3 GPM of bleed water. Thus, the total makeup water requirement will be about 25.8 GPM. Over the course of a year of operation, approximately 1.6 million gallons of bleed water will be discharged and approximately 13.5 million gallons of makeup water will be consumed. Any of the discharged water that is put to no other use must be disposed of.

Figure 2A:
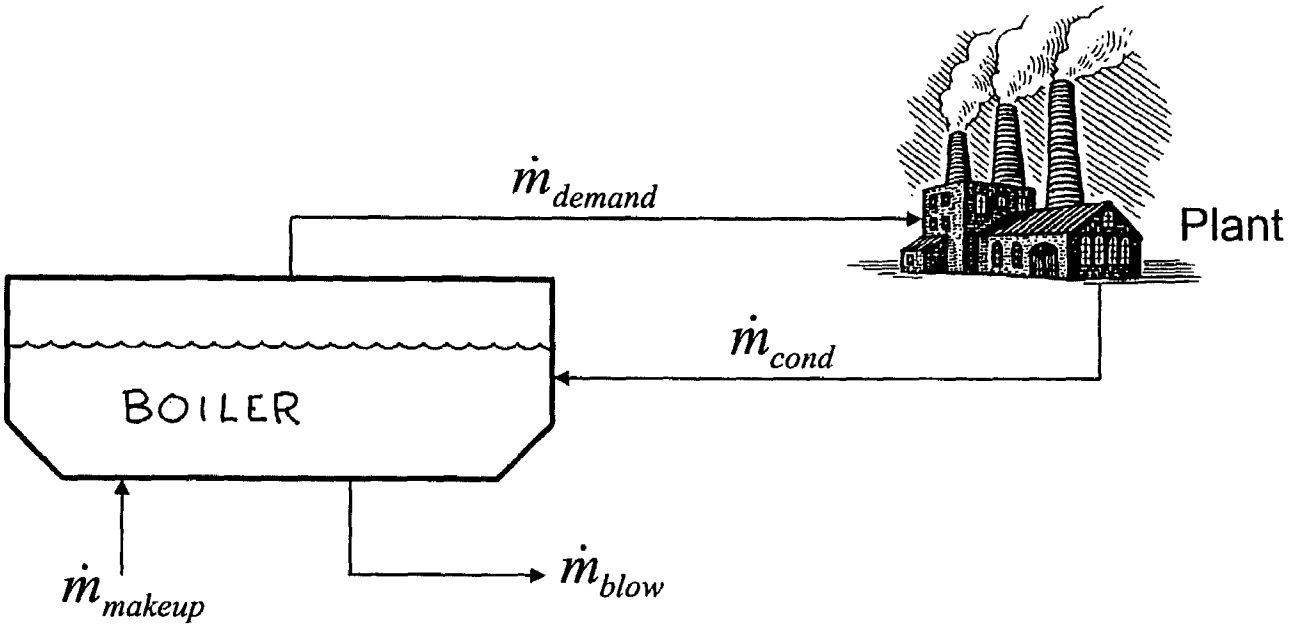
FIG. 2A is a schematic depicting the mass balance of water for a boiler.

There is shown in FIG. 2A a schematic diagram and mass balance of water for an embodiment of an industrial boiler. The boiler typically combusts a solid fuel (not shown) to heat water into steam, and the exhaust gases from the combustion process become the flue gas treated by the WESP. An amount of steam, denoted as $m_{demand}$, is supplied to an industrial plant, were some of the steam is consumed, and an amount of condensate, denoted as $m_{cond}$, is returned to the boiler for reuse. The ratio of the mass flow rate of condensate to the mass flow rate of demand ($m_{cond}/m_{demand}$) is termed the condensate return, which is expressed in a percentage less than 100%. Another amount of water, denoted as $m_{blow}$, is extracted from the bottom of the boiler in a blow down process to remove accumulated solids and other contaminants. The frequency of boiler blow down is based on the conductivity of the water in the steam drum of the boiler, which is indicative of dissolved solids. Therefore, blow down is usually done when the conductivity of the water in the boiler steam drum reaches approximately this level.

Figure 2B:
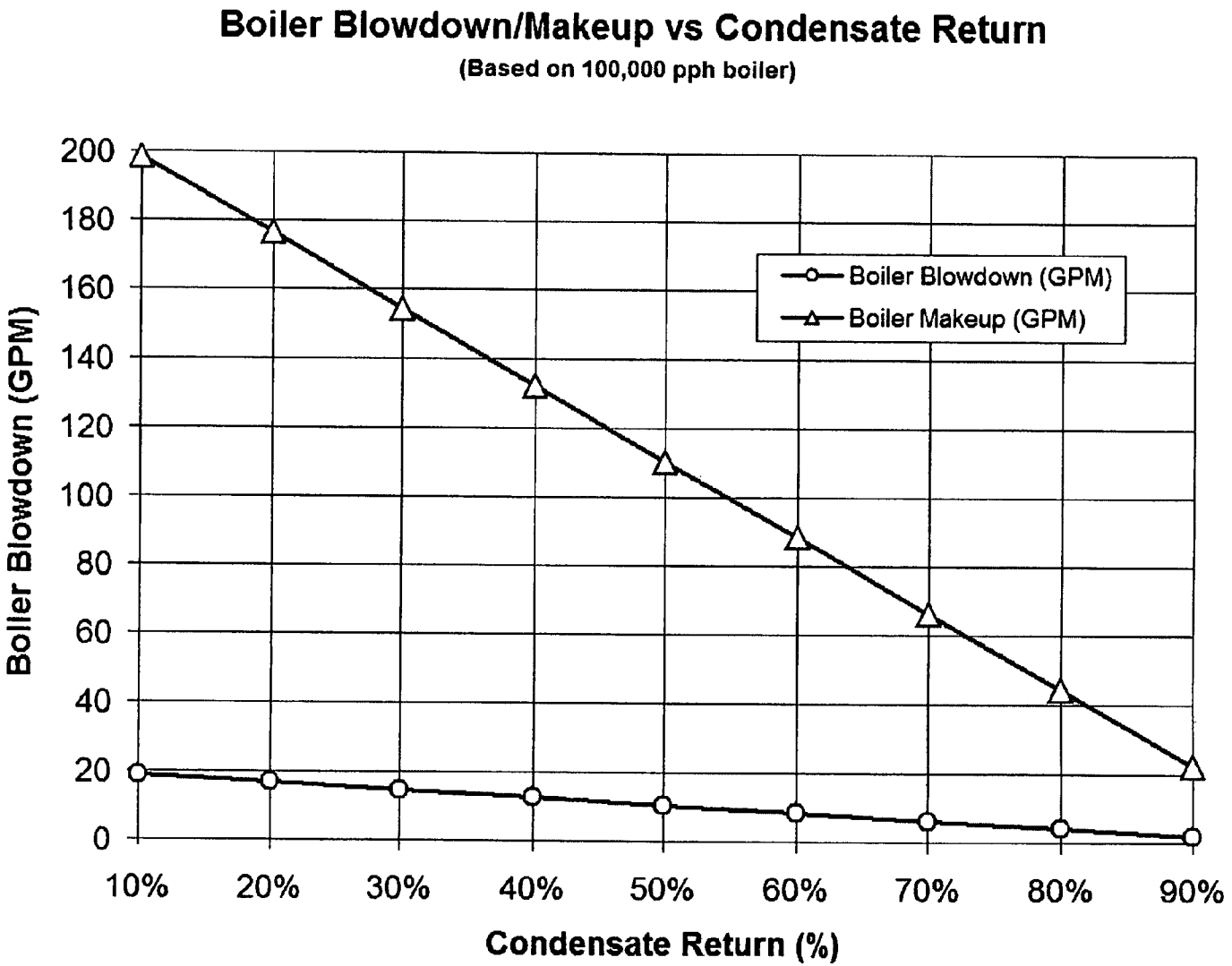
FIG. 2B is a graph showing the variation in required boiler blow down flow rate and boiler make up flow rate as a function of the percentage of condensate return to the boiler.

As a result of the use of steam by the plant, as well as blow down discharges, a replacement amount of water, denoted as $m_{makeup}$, must be periodically added to the boiler in order to achieve a mass balance of water, wherein $m_{makeup}=m_{demand}+m_{blow}-m_{cond}$. FIG. 2B shows that the required amount of blow down water, and as a result the required amount of boiler makeup water, depends on the output of the boiler (the graph being for a boiler generating 100,000 pounds per hour of steam) and the condensate return. For a lower condensate return (i.e., more of the steam from the boiler is consumed by the industrial plant), more steam is consumed, more boiler blow down water is discharged, and more boiler makeup water is required.

The amounts of makeup water required and blow down water discharged by a boiler can be substantial. In one example, for a boiler creating 100,000 pounds per hour of steam and a plant consuming about 50% of the steam and returning about 50% of the steam as condensate, and with blow down performed when the conductivity of the steam drum water reaches about 4,000 μS/cm, about 100 GPM feed water in the form of steam is consumed by the plant, about 100 GPM of condensate is returned to the boiler, about 10.5 GPM is discharged during blow down, and about 110 GPM of makeup water is required. Of the about 10.5 GPM of blow down water, about 1.2 GPM could be used to quench ash from the boiler combustion process, leaving about 9.3 GPM requiring disposal. Over the course of a year of operation, approximately 5 million gallons of blow down water will be discharged and approximately 58 million gallons of makeup water will be consumed. Any of the discharged water that is put to no other use must be disposed of.

To reduce the amount of makeup water consumed by both the boiler and the WESP and to reduce the amount of blow down and bleed water discharged for disposal, boiler blow down water can be used as makeup water for the WESP. In particular, because the boiler is typically made from carbon steel while the WESP is typically made from stainless steel or other similar corrosion resistant material, the WESP can tolerate higher chloride and dissolved solids concentrations than the boiler. Thus, the blow down water from the boiler can be used productively in the WESP until the concentrations reach the WESP tolerance level.

Figure 3A:
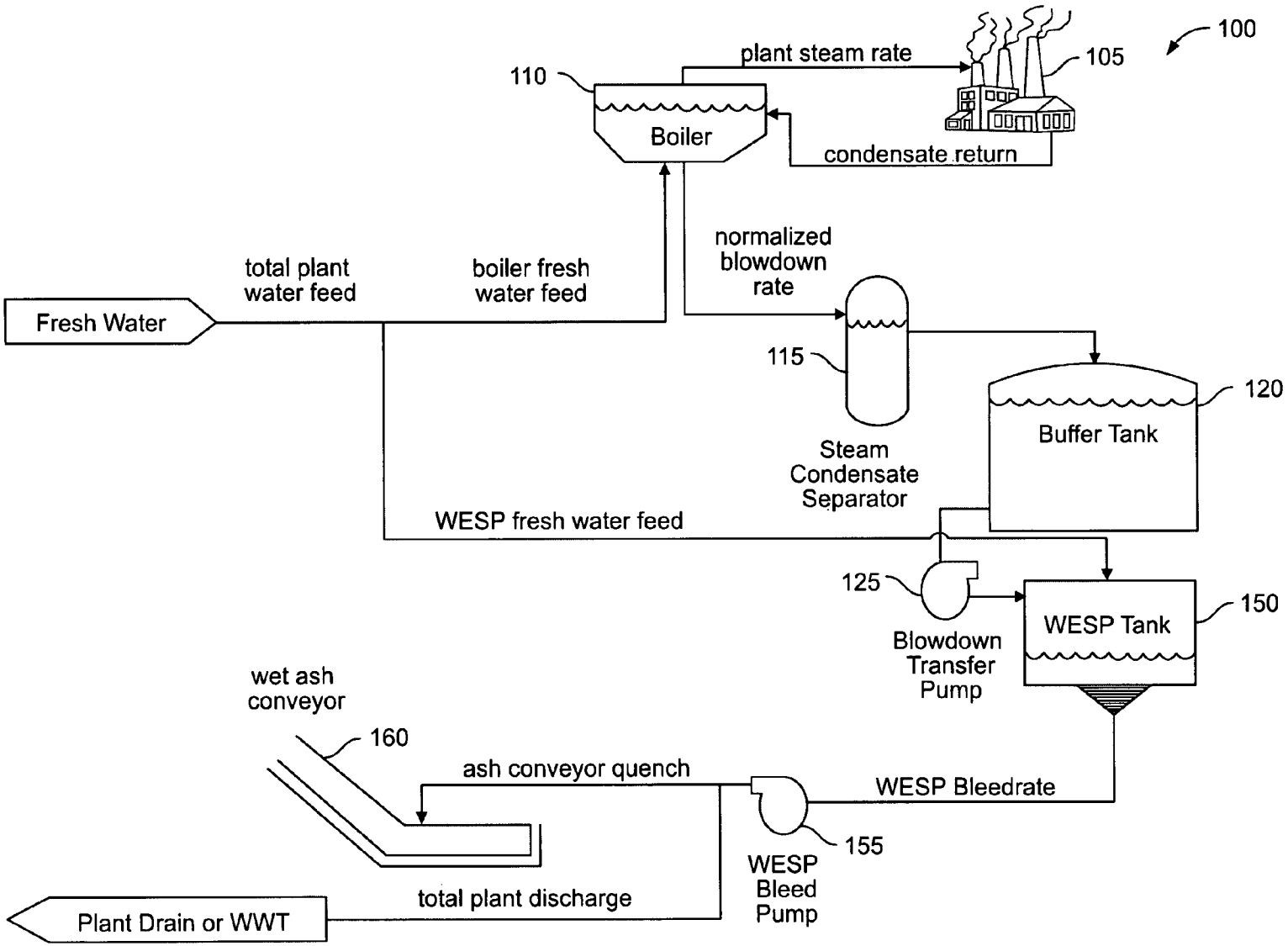
FIG. 3A is a schematic depicting an embodiment of a method and apparatus for reducing the amount of waste water effluent from a system including a solid fuel boiler and a wet electrostatic precipitator.

FIG. 3A is a schematic of one embodiment of an integrated system 100 including a boiler 110 and a WESP 150. A common fresh water feed is provided to supply both the boiler 110 and the WESP 150, and a common plant drain or discharge is provided to receive effluent discharge from the system 100. The boiler 110 supplies steam at a plant steam rate to a plant 105, which consumes a portion of the steam and returns the remainder to the boiler 110 as condensate return. Blow down water is discharged periodically from the boiler 110 (indicated as a normalized blow down rate, which is averaged over time) to a steam condensate separator 115 and then to a buffer tank 120. The buffer tank 120 is sized to hold at least one blow down cycle of the boiler so a steady amount of makeup water can be supplied to the WESP 150. Fresh makeup water is supplied to the boiler to make up for losses due to plant usage and blow down.

The WESP 150 consumes an amount of water by evaporation into the boiler flue gas (not shown in FIG. 3A), and a further amount of water due to the removal of bleed water. The boiler blow down water retained in the buffer tank 120 constitutes a portion of the makeup water supplied to the WESP, the blow down water being pumped from the buffer tank 120 to the WESP 150 by a blow down transfer pump 125. However, because the boiler 110 normally does not generate sufficient blow down water to match the amount of water consumed by the WESP 150, a supplementary amount of fresh makeup water is also provided to the WESP 150. Bleed water discharged by the WESP 150 is pumped away (Pump 155), with a portion of the bleed water being used to quench boiler ash by being sprayed onto a wet ash conveyor 160, and the remainder of the bleed water being sent to plant discharge.

Figure 3B:
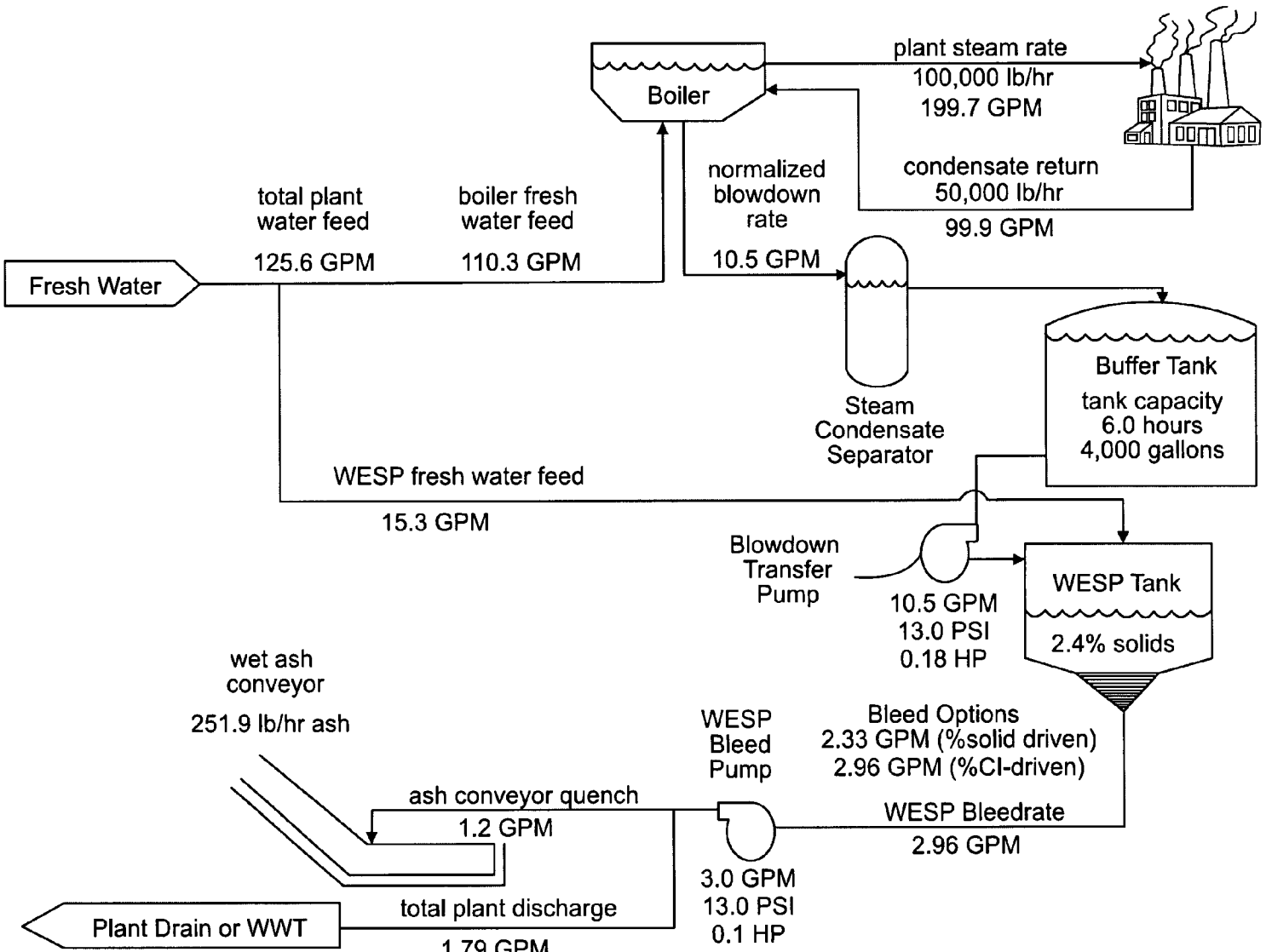
FIG. 3B is a schematic depicting an exemplary mass balance of water for a method and apparatus of FIG. 3A.

In an example, as shown in FIG. 3B, a boiler 110 generates 100,000 pounds per hour of steam at an 80% boiler efficiency. The plant 105 has a condensate return to the boiler 110 of 50%, and an assumed solid content of 30% for the ash conveyor 160. The boiler flue gas sent to the WESP 150 is about 67,000 ACFM at 400° F., with an approximately 22.8 GPM quench water requirement. The boiler 110 mass balance indicates that about 200 GPM feed water transformed into steam is provided by the boiler 110 to the plant 105 and about 100 GPM is returned to the boiler 110 as condensate, yielding a boiler makeup water requirement of about 110 GPM and a blow down discharge of about 10 GPM. The boiler blow down water is used to reduce the WESP fresh makeup water requirement from about 25.8 GPM to about 15.3 GPM, the balance of about 10.5 GPM coming from the buffer tank 120 which stores the boiler blow down water. In one embodiment, the buffer tank 120 has a capacity of about 4,000 gallons, or about 6 hours of blow down water from the boiler 110. Of the about 3 GPM of bleed water discharged from the WESP 150, about 1.2 GPM is used to quench the ash on the wet ash conveyor 160 and the remaining about 1.8 GPM is sent to plant discharge. The net result of the depicted embodiment is as follows:

| Parameter (GPM) | Prior Art | Embodiment of FIG. 3A |
|---|---|---|
| Boiler Makeup Water | 110.3 | 110.3 |
| WESP Makeup Water | 25.8 | 15.3 |
| Total Makeup Water | 136.1 | 125.6 |
| Boiler Blow Down | 10.5 | 10.5 |
| Boiler Blow Down to Discharge | 10.5 | 0 |
| WESP Bleed | 3.0 | 3.0 |
| WESP Bleed to Discharge | 3.0 | 1.8 |
| Total Water Discharge | 13.5 | 1.8 |

Figure 4:
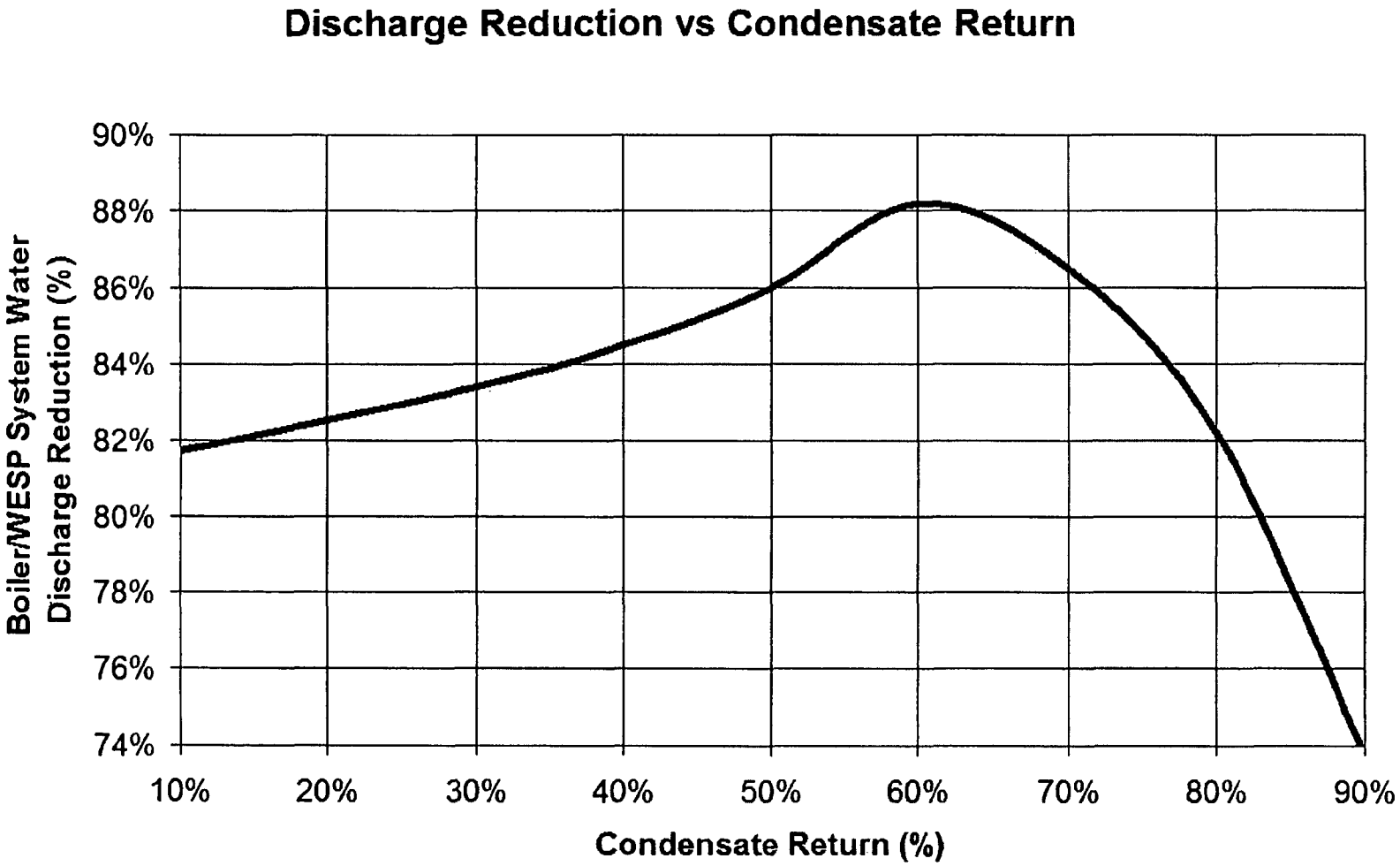
FIG. 4 is a graph showing the percent reduction of waste water effluent achieved by the method and apparatus of FIG. 3A as a function of condensate return to the boiler.

Thus, the exemplary embodiment of FIG. 3B achieves a net reduction in makeup water requirement of 10.5 GPM (41% of WESP makeup water and 8% of total makeup water) and a net reduction in water discharge of 11.7 GPM (100% of boiler blow down water and 40% of WESP bleed water, or 87% of total discharge water). FIG. 4 shows the reduction of boiler and WESP system water discharge as a function of condensate return. For any level of condensate return of 80% or less, a water discharge reduction of better than 80% can be achieved, and for high levels of condensate return (e.g., greater than about 90%), water discharge reduction is reduced because the discharge rate stays constant at a low flow due to solids concentration limitations. Thus, although the amount of water discharged can be greatly reduced by an embodiment of the method and apparatus of FIGS. 3A and 3B, to achieve zero water discharge, the remaining water must be diverted from discharge.

Figure 5A:
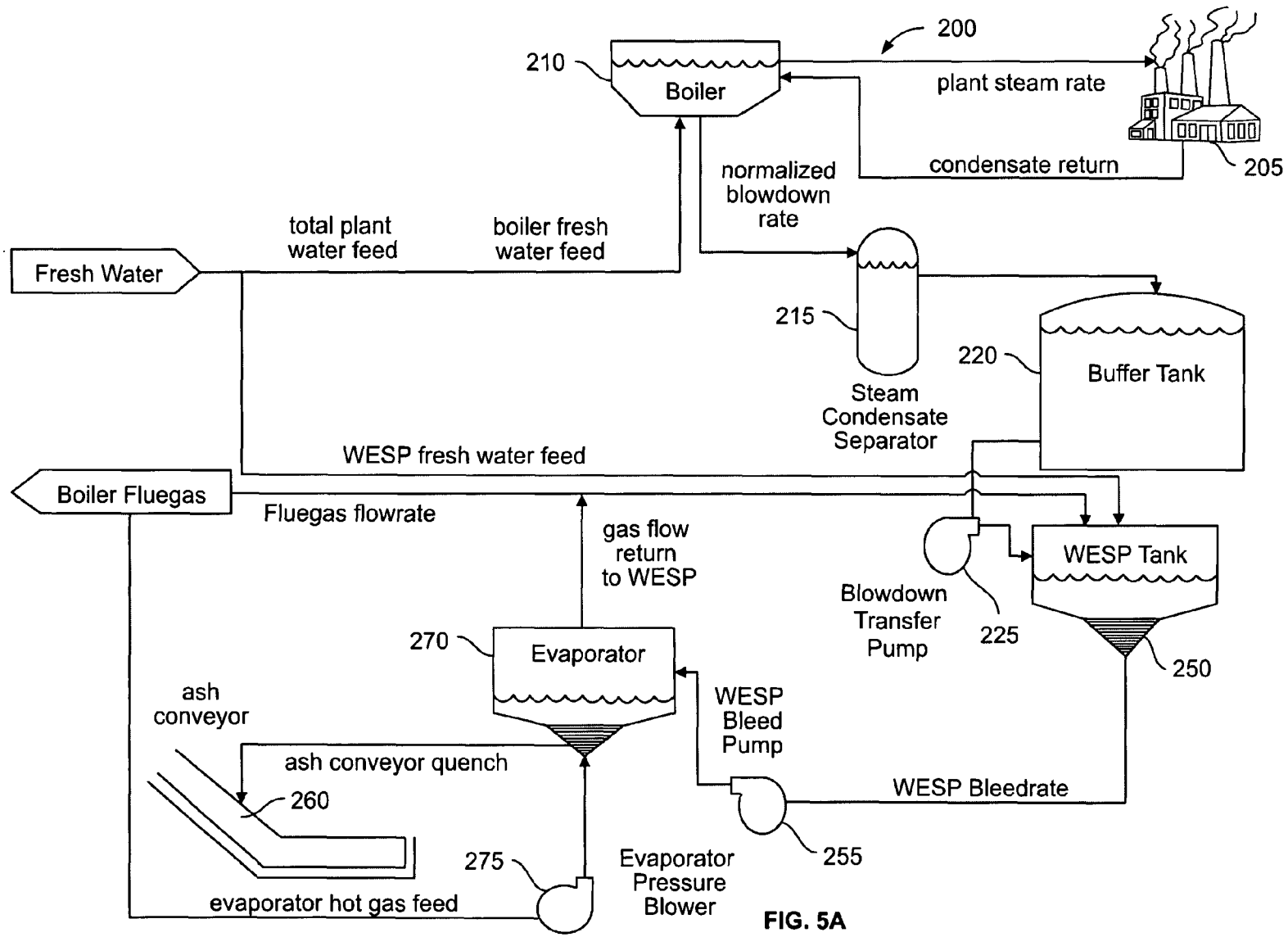
FIG. 5A is a schematic depicting an embodiment of a method and apparatus for eliminating the amount of waste water effluent from a system including a solid fuel boiler and a wet electrostatic precipitator. (Zero Discharge)

FIG. 5A is a schematic of another embodiment of an integrated system 200 including a boiler 210 and a WESP 250. A common fresh water feed is provided to supply both the boiler 210 and the WESP 250. The boiler 210 supplies steam at a plant steam rate to a plant 205, which consumes a portion of the steam and returns the remainder to the boiler 210 as condensate return. Blow down water is discharged periodically from the boiler 210 (indicated as a normalized blow down rate, which is averaged over time) to a steam condensate separator 215 and then to a buffer tank 220. The buffer tank 220 is sized to hold at least one blow down cycle of the boiler so a steady amount of makeup water can be supplied to the WESP 250. Fresh makeup water is supplied to the boiler to make up for losses due to plant usage and blow down.

The WESP 250 consumes an amount of water by evaporation into the boiler flue gas, and a further amount of water due to the removal of bleed water. The boiler blow down water retained in the buffer tank 220 constitutes a portion of the makeup water supplied to the WESP, the blow down water being pumped from the buffer tank 220 to the WESP 250 by a blow down transfer pump 225. However, because the boiler 210 normally does not generate sufficient blow down water to match the amount of water consumed by the WESP 250, a supplementary amount of fresh makeup water is also provided to the WESP 250. Bleed water discharged by the WESP 250 is pumped (Pump 255) to an evaporator 270. A portion of the bleed water is evaporated and returned to the WESP 250 as steam, and the remainder of the bleed water is used to quench boiler ash by being sprayed onto a wet ash conveyor 260.

In one embodiment, the evaporator 270 can be an electrically or steam heated or direct-fired natural gas burner can be used, which would consume about 10,000 BTUs of energy for every gallon of water evaporated. E.g., at a $10/MMBtu natural gas prices, this would be about 10 cents per gallon for natural gas alone.

In another embodiment, the energy of the boiler flue gas can be used in the evaporator 270 to evaporate a portion of the bleed gas, which simultaneously accomplishes a reduction in flue gas temperature. As shown in FIG. 5A, a portion of the flue gas is directed to the evaporator 270, such that the flue gas exiting the evaporator is saturated and is quenched to its wet-bulb temperature. Moreover, the amount of quench water required in the WESP 250 is a function of both the flue gas temperature and the flue gas moisture content, so by cooling and humidifying a portion of the flue gas, the amount of quench water required by the WESP 250 is reduced. The rate of evaporation of bleed water in the evaporator 270 is a function of both the flue gas flow rate and the flue gas temperature. In one example, 2 GPM of bleed water can be evaporated by about 20,000 ACFM of flue gas at 300° F. or by about 15,000 ACFM of flue gas at 400° F. Infinite other combinations are possible. The most preferred of several possible embodiments of the evaporator comprises a vessel into which bleed water can be pumped, provides for flue gas to be sparged into the vessel beneath the liquid level such that the flue gas becomes quenched as it bubbles upward toward an outlet, and further provides for solids-containing fluid to be removed from the bottom of the vessel (and used, e.g., to quench ash). Other commercially available or custom-made equivalent evaporators 270 with similar functions could be used.

Figure 5B:
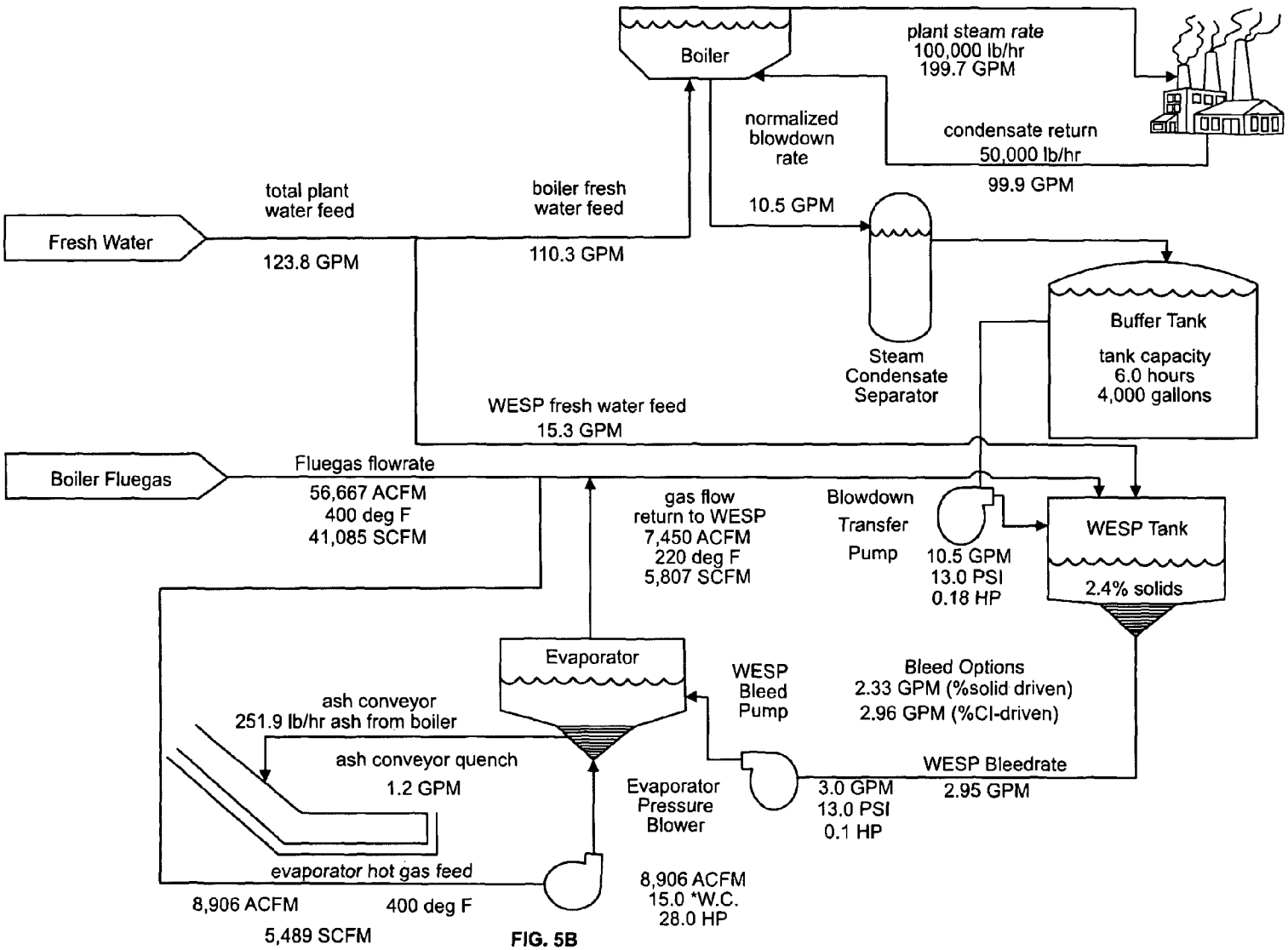
FIG. 5B s a schematic depicting an exemplary mass balance of water for a method and apparatus of FIG. 5A. (Zero Discharge)

In an example, as shown in FIG. 5B, a boiler 210 generates 100,000 pounds per hour of steam at an 80% boiler efficiency. The plant 205 has a condensate return to the boiler 210 of 50%, and an assumed solids content of 30% for the ash conveyor 260. The boiler flue gas to the WESP 250 is 67,000 ACFM at 400° F., with an approximately 22.8 GPM quench water requirement. The boiler 210 mass balance requires a boiler makeup water requirement of about 110 GPM and a blow down discharge of about 10 GPM. The boiler blow down water is used to reduce the WESP fresh makeup water requirement from about 25.8 GPM to about 13.5 GPM, the balance of about 10.5 GPM coming from the buffer tank 120 which stores the boiler blow down water and from the evaporator 270 (1.8 GPM equivalent in form of pre-quenched flue gas). In one embodiment, the buffer tank 220 has a capacity of about 4,000 gallons, or about 6 hours of blow down water from the boiler 210. Of the about 3 GPM of bleed water discharged from the WESP 250, about 1.8 GPM is evaporated into the flue gas in the evaporator 270 and about 1.2 GPM is used to quench the ash on the wet ash conveyor 260. No water is sent to plant discharge. The amount of flue gas that must be diverted to the evaporator 270 is about 8,900 ACFM, or about 13% of the total flue gas flow. The net result of the depicted embodiment is as follows:

| Parameter (GPM) | Prior Art | Embodiment of FIG. 5A |
|---|---|---|
| Boiler Makeup Water | 110.3 | 110.3 |
| WESP Makeup Water | 25.8 | 13.5 |
| Total Makeup Water | 136.1 | 123.8 |
| Boiler Blow down | 10.5 | 10.5 |
| Boiler Blow Down to Discharge | 10.5 | 0 |
| WESP Bleed | 3.0 | 3.0 |
| WESP Bleed to Discharge | 3.0 | 0 |
| Total Water Discharge | 13.5 | 0 |

Thus, the exemplary embodiment of FIG. 5B achieves a net reduction in makeup water requirement of 12.3 GPM (48% of WESP makeup water or 9% of total makeup water) and a net reduction in water discharge of 13.5 GPM (100% of total discharge water).

Figure 6:
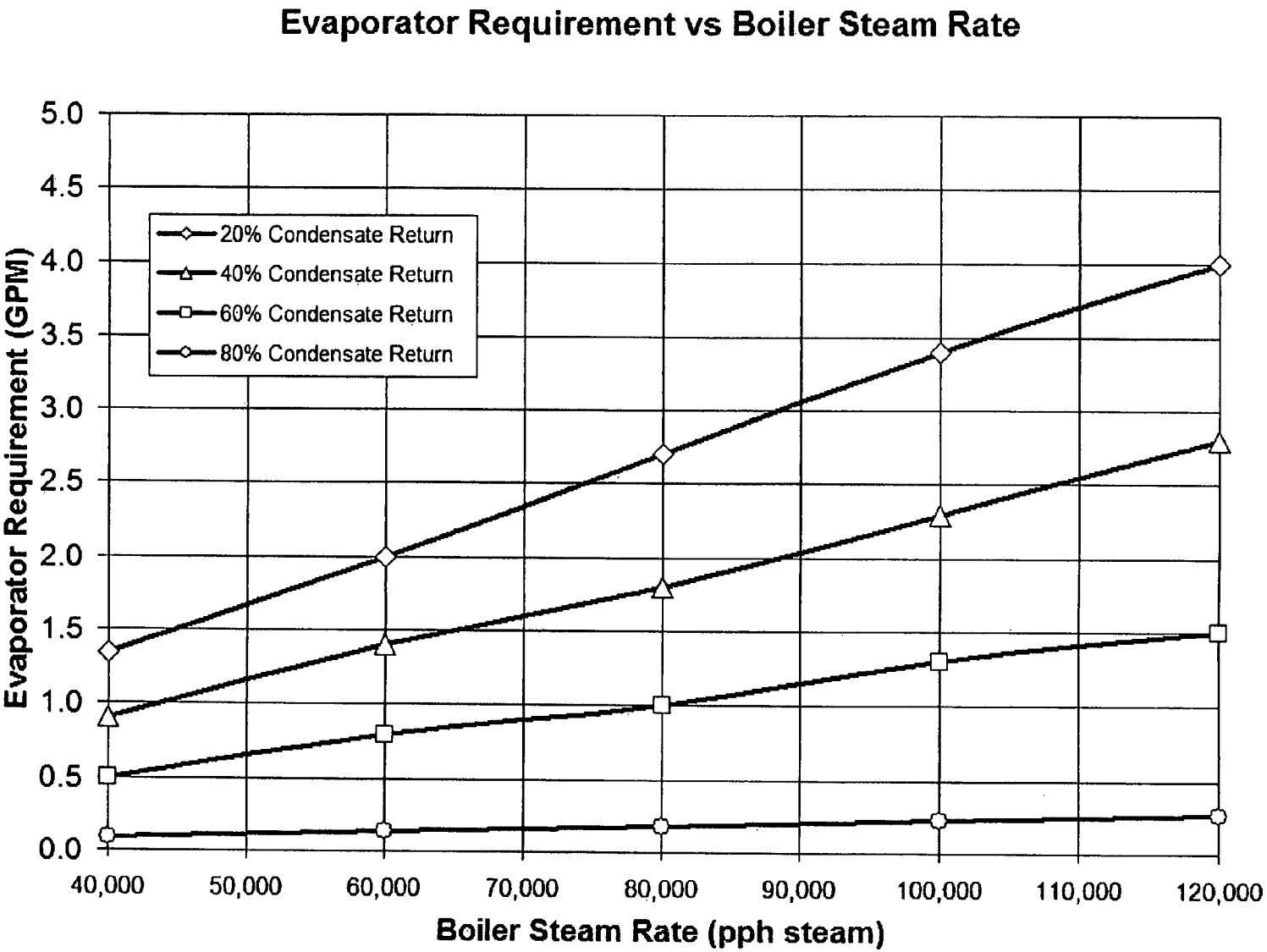
FIG. 6 is a graph showing exemplary evaporator capacity requirements as a function of boiler size, for various rates of condensate return to the boiler.

The operating costs for an evaporator using flue gas to evaporate a portion of the bleed water are substantially less than those of a direct-fired natural gas evaporator as there is no purchased fuel needed to run it and all energy comes from waste heat in the flue gas. Operating costs decrease, as expected, in inverse proportion to the percent of condensate return to the boiler. FIG. 6 shows, for a given boiler steam rate, what size evaporator would be required.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A method for reducing waste effluent from a system including a boiler and a wet electrostatic precipitator, the waste effluent comprising blow down water discharged from the boiler during a blow down operation and bleed water discharged by the wet electrostatic precipitator, the method comprising:

collecting the blow down water; and providing the collected blow down water to the wet electrostatic precipitator as a makeup water supplement;

thereby simultaneously reusing the blow down water and reducing the fresh makeup water requirement for the wet electrostatic precipitator.

2. The method of claim 1, further comprising:

evaporating at least a portion of the bleed water;

using a flue gas slip stream to evaporate bleed water; and providing pre-quenched flue gas to the wet electrostatic precipitator further reducing water make-up requirements, thereby simultaneously reducing the bleed water waste effluent from the wet electrostatic precipitator and further reducing the fresh makeup water requirement for the wet electrostatic precipitator.

3. The method of claim 2, wherein the portion of bleed water evaporated is less than all of the bleed water such that residual bleed water remains, the method further comprising:

using the residual bleed water to quench ash produced by combustion of solid fuel by the boiler;

thereby reducing to zero the bleed water waste effluent from the system.

4. The method of claim 2, wherein the evaporating step comprises evaporating all of the bleed water, thereby reducing to zero the bleed water waste effluent from the wet electrostatic precipitator.

5. The method of claim 2, wherein the evaporating step comprises contacting the bleed water with hot flue gas from the boiler to humidify the hot flue gas, and wherein the providing step comprises providing the quenched flue gas to the wet electrostatic precipitator.

6. The method of claim 1, wherein the blow down water is collected in a buffer tank having a capacity sufficient to retain an amount of water produced by at least one boiler blow down operation.

7. The method of claim 1, further comprising:

using at least a portion of the bleed water to quench ash produced by combustion of solid fuel by the boiler.

8. The method of claim 7, wherein the portion of the bleed water used to quench the ash is less than all of the bleed water, the method further comprising:

evaporating the residual bleed water; and using a flue gas slip stream to evaporate the residual bleed water; and providing pre-quenched flue gas to the wet electrostatic precipitator further reducing water make-up requirements;

thereby simultaneously reducing to zero the bleed water waste effluent from the wet electrostatic precipitator and further reducing the fresh makeup water requirement for the wet electrostatic precipitator.

9. The method of claim 8, wherein the evaporating step comprises contacting the bleed water with hot flue gas from the boiler to humidify a portion of the hot flue gas, and wherein the providing step comprises providing the quenched flue gas to the wet electrostatic precipitator.

10. The method of claim 7, wherein the portion of bleed water used to quench the ash is all of the bleed water; thereby reducing to zero the bleed water waste effluent from the wet electrostatic precipitator.

11. A method for reducing the bleed water waste effluent from a wet electrostatic precipitator, comprising:

evaporating at least a portion of the bleed water;

using a flue gas slip stream to evaporate the bleed water; and providing pre-quenched flue gas to the wet electrostatic precipitator further reducing water make-up requirements, thereby simultaneously reducing the bleed water waste effluent and reducing the fresh makeup water requirement for the wet electrostatic precipitator.

12. The method of claim 11, wherein the portion of bleed water evaporated is less than all of the bleed water such that residual bleed water remains, the method further comprising:

using the residual bleed water to quench ash produced by combustion of solid fuel by the boiler;

thereby reducing to zero the bleed water waste effluent from the wet electrostatic precipitator.

13. The method of claim 11, wherein the evaporating step comprises contacting the bleed water with hot flue gas from the boiler to humidify a portion of the hot flue gas, and wherein the providing step comprises providing the quenched flue gas to the wet electrostatic precipitator.

14. A method for reducing to zero the waste effluent from a system including a boiler and a wet electrostatic precipitator, the waste effluent comprising blow down water discharged by the boiler during a blow down operation and bleed water discharged by the wet electrostatic precipitator, the method comprising:

collecting the blow down water;

providing the collected blow down water to the wet electrostatic precipitator as a makeup water supplement;

evaporating a portion of the bleed water and leaving residual bleed water;

using a flue gas slip stream to evaporate the residual bleed water;

providing pre-quenched flue gas to the wet electrostatic precipitator further reducing water make-up requirements; and using the residual bleed water to quench ash produced by combustion of solid fuel by the boiler;

thereby reducing to zero the waste effluent from the system.

15. The method of claim 14, wherein the evaporating step comprises contacting the bleed water with hot flue gas from the boiler to humidify a portion of the hot flue gas, and wherein the providing step comprises providing the quenched flue gas to the wet electrostatic precipitator.

16. The method of claim 14, wherein the blow down water is collected in a buffer tank having a capacity sufficient to retain the water produced by at least one boiler blow down operation.

17. A waste effluent reduction apparatus comprising:

a boiler discharging blow down water;

a wet electrostatic precipitator discharging bleed water;

the waste effluent comprising the blow down water and bleed water;

an evaporator for evaporating at least a portion of the bleed water by using a flue gas slip stream to evaporate the bleed water; and the evaporator also providing pre-quenched flue gas to the wet electrostatic precipitator further reducing water make-up requirements.

18. The apparatus of claim 17, wherein the evaporator provides direct contact between hot boiler flue gas and the bleed water such that a portion of the flue gas is quenched before being provided to the wet electrostatic precipitator.

19. The apparatus of claim 17, wherein the portion of the bleed water evaporated by the evaporator is less than all of the bleed water such that residual bleed water remains, further comprising:

a device for providing the residual bleed water to quench ash produced by the combustion of solid fuel by the boiler.

20. The apparatus of claim 17, further comprising:

a buffer tank for collecting blow down water from the boiler; and a device for transferring the blow down water from the buffer tank to the wet electrostatic precipitator as a makeup water supplement;

thereby reducing the fresh makeup water requirement of the wet electrostatic precipitator.

* * * * *